United States Patent [19]

Ryder

[11] Patent Number: 4,678,102

[45] Date of Patent: Jul. 7, 1987

[54] CONTAINER HAVING A HOOKED-SHAPED MEMBER SLIDABLY ATTACHED THERETO

[75] Inventor: Geoffrey A. Ryder, Welwyn Garden City, England

[73] Assignee: Beecham Group p.l.c., England

[21] Appl. No.: 782,507

[22] Filed: Oct. 1, 1985

[30] Foreign Application Priority Data

Oct. 3, 1984 [GB] United Kingdom ..... 8424958

[51] Int. Cl.[4] ..... B67D 5/06

[52] U.S. Cl. ..... 222/181; 248/318; 248/359

[58] Field of Search ..... 222/180, 181; 248/359 C, 359 G, 359 H, 318

[56] References Cited

U.S. PATENT DOCUMENTS

| | | | |
|---|---|---|---|
| 2,362,523 | 11/1944 | Armstrong et al. | 222/181 X |
| 2,547,744 | 4/1951 | Burger | 222/181 X |
| 2,795,454 | 6/1957 | Snook | 248/318 X |
| 2,799,882 | 7/1957 | Falk | 248/318 X |
| 3,310,270 | 3/1967 | Ciancio | 248/318 X |
| 3,768,684 | 10/1973 | Buchtel | 248/359 C X |
| 4,166,553 | 9/1979 | Fraterrigo | 222/181 |

FOREIGN PATENT DOCUMENTS

| | | | |
|---|---|---|---|
| 521890 | 8/1953 | Belgium | 248/318 |
| 862757 | 12/1940 | France | 248/359 |
| 1443 | of 1895 | United Kingdom | 248/359 H |
| 2098958 | 12/1982 | United Kingdom | 222/181 |

*Primary Examiner*—Joseph J. Rolla
*Assistant Examiner*—Frederick R. Handren
*Attorney, Agent, or Firm*—Jacobs & Jacobs

[57] ABSTRACT

A container (1) for dispensing viscous liquids consists of a hollow, resilient oval body (2) having a valve cap (6), and a hook-shaped support (7) slidably attached to the body (2). The support (7) may be fully extended and the hook (9) used to suspend the container (1) from a shower rail. Liquid may then be obtained from the container (1) by squeezing the body (2).

5 Claims, 5 Drawing Figures

CONTAINER HAVING A HOOKED-SHAPED MEMBER SLIDABLY ATTACHED THERETO

The present invention relates to a container, and in particular to a container for dispensing viscous liquids such as liquid detergents.

A container for dispensing liquid detergent is disclosed in UK Patent Specification No. 2098958. The container described therein comprises a resiliently deformable plastics bottle having a valve cap mounted on the outlet, and a hook-shaped cap which can be fastened on either the top or the bottom of the bottle. This arrangement enables the container to be suspended from, for example, a shower rail, while detergent is dispensed by squeezing the bottle. A disadvantage of the arrangement is that, if the hook-shaped cap is lost, the dispenser cannot function in its intended manner.

A viscous liquid dispensing container has now been designed which overcomes the above problem by including a hook-shaped suspending member as a non-detachable part of the container, the suspending member being extendable and retractable for use and non-use respectively.

According to the present invention there is provided a container for dispensing viscous liquids, comprising a hollow resiliently deformable body having a valve cap mounted thereon, and a hook-shaped member slidably attached to the body, the body and the hook-shaped member having mutual stop means to limit slidable movement, whereby the member may be extended to suspend the container in an inverted position and retracted when the container is not in use.

Preferably, the hook-shaped member comprises an arcuate portion arranged to encircle, at least partially, the deformable body, and a hook, depending form the arcuate portion, which extends in a direction substantially parallel to the body wall. The arcuate portion preferably has C-shaped configuration.

The stop means is preferably provided by a circumferential ledge formed on the body near the bottom thereof, which ledge abuts the hook shaped member when the latter is extended.

Preferably the body has a circular or oval cross section, and the hook is contoured to follow the cross section shape. By this means, the hook is retained close to the body, thereby providing a more pleasing aesthetic appearance and, by avoiding awkward projections, reducing the risk of accidental breakage of the hook.

The hook-shaped member may be attached to the body so that there is a friction fit between the member and the body. This enables the member to remain in a fixed state when retracted, held in position by the friction fit.

The body and the hook-shaped member are conveniently made of plastics material, though the hook-shaped member should have some rigidity to provide adequate support for the container when suspended from, for example, a shower rail.

The container of the invention will now be described, by way of example with reference to the following drawings, in which.

Figure 1:
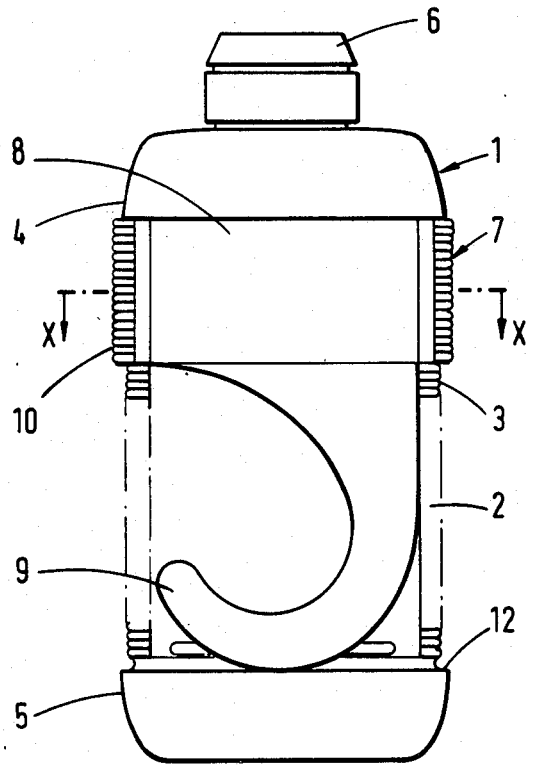
FIG. 1 is a front elevation of a container with its supporting hook in the retracted position.

Referring generally to the drawings, a container 1 for dispensing liquid detergent comprises a hollow plastics body 2 of generally oval cross section, the two wider side walls of the body 2 being manually compressible to eject liquid from the body. The two narrower side walls of the body 2 are each formed with parallel horizontal ribs 3, best seen in FIG. 3, which extend the full distance between upper portion 4 and lower portion 5 of the body 2.

The aperture of the body 2 is covered by a valve cap 6 which only permits exit of liquid when the body 2 is squeezed. By this means, the container 1 can be suspended upside down without liquid leaking from it.

Valve caps which are suitable for this purpose are well known in the art, and one such cap is that described in the aforementioned UK Patent Specification No. 2098958. Another such cap is that marketed by Calmar under the trade name AUTOCAP.

Figure 3:
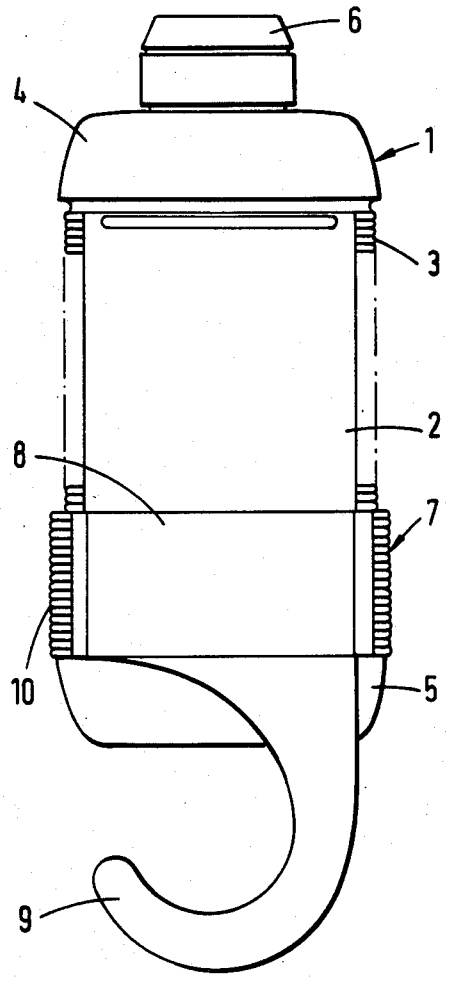
FIG. 3 is a front elevation of the container of FIG. 1 with the supporting hook in its extended position.
Figure 4:
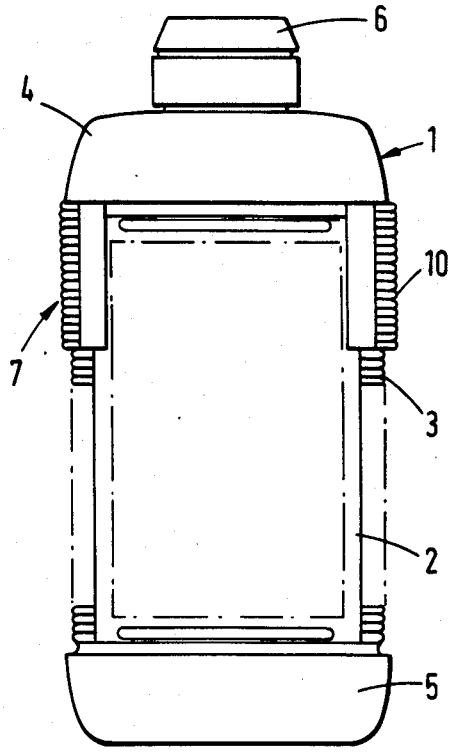
FIG. 4 is a rear elevation of the container of FIG. 1.
Figure 5:
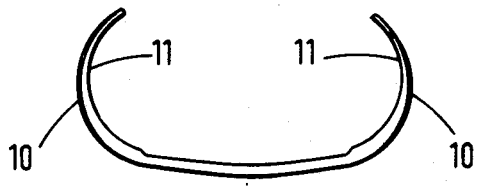
FIG. 5 is a section along X—X of FIG. 1 showing the supporting hook only.

A hook-shaped member 7 is slidably attached to the body 2 and consists of a generally C-shaped portion 8 which partially encircles the body 2, and a hook 9 which depends from the portion 8. The C-shaped portion 8 is slidable down the body 2, the limits of movement being shown in FIG. 1 (fully retracted) and FIG. 3 (fully extended). The portion 8 has horizontal parallel ribs 10 formed on the outside surface to assist in manually gripping the member 7, and has a smooth interior surface 11 which may, if desired, frictionally engage the ribs 3 on the body 2 to maintain the member 7 in position on the body 2. The limit of extension of the hook 9, as shown in FIG. 3, is controlled by means of a ledge 12 on the bottom portion 5 of the body 2 abutting the bottom edge of the C-shaped portion 8. Similarly, the limit of retraction of hook 9, as shown in FIG. 1, is controlled by a ledge 13, on the top portion 4 of the body 2 abutting the top edge of C-shaped portion 8.

Figure 2:
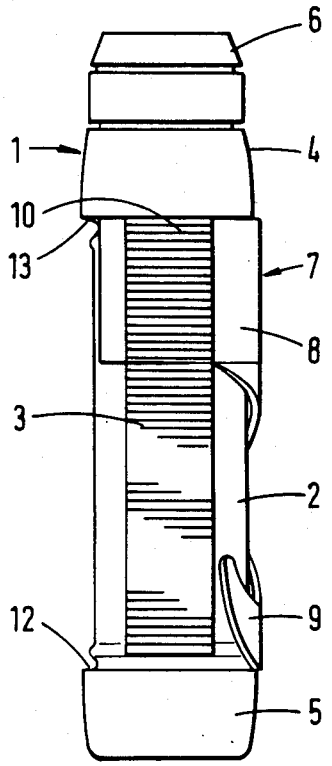
FIG. 2 is a side elevation of the container of FIG. 1.

The hook 9 is relatively thin, as can be seen in FIG. 2, but has a curvature which follows that of the body 2. As well as being aesthetically pleasing, this reduces the risk of breaking the hook 9 when in its retracted position since there are no projecting parts which could be easily snapped off. In use, the hook 9 is extended to the position shown in FIG. 3 and the container 1 is suspended upside down from a suitable support such as a rail. The user may then obtain liquid from the container 1 by simply squeezing the body 2.

The valve cap 6 prevents leakage of liquid out of the container 1. After use, the hook 9 is manually retracted to its position as shown in FIG. 1, thereby enabling the container 1 to be stood on a flat surface, such as on a shelf or a cupboard.

I claim:

1. A container for dispensing viscous liquids, comprising a hollow resiliently deformable body having top and bottom ends connected by a body wall, a valve cap mounted at the top end of the body, and a hook-shaped member attached to the body for slidable movement along the body wall in a direction between the top and bottom ends, the hook shaped member comprising an arcuate portion arranged to encircle at least partially the deformable body, and a hook depending from the arcuate portion and extending in a direction parallel to the body wall and being shaped and contoured to follow the body cross-section, the body and the hook-shaped member having mutual stop means to limit slidable movement of said hook-shaped member between a retracted position which causes said hook to lie along said body wall and not project beyond the bottom end of the body and an extended position which causes said hook to project beyond said bottom end, whereby the member may be extended to suspend the container in an inverted position and retracted when the container is not in use.

2. A container according to claim 1, in which the arcuate portion has a C-shaped configuration.

3. A container according to claim 1, in which the stop means is provided by a circumferential ledge formed on the body near the bottom thereof, which ledge abuts the hook shaped member when the latter is extended.

4. A container according to claim 1, in which the body has a circular or oval cross section, and the hook is shaped and contoured to follow the cross section.

5. A container according to claim 1, in which there is a friction fit between the hook shaped member and the body.

* * * * *